US006306677B1

(12) United States Patent
Vargo et al.

(10) Patent No.: US 6,306,677 B1
(45) Date of Patent: Oct. 23, 2001

(54) METHOD AND APPARATUS FOR PUNCH AND PLACE INSERTS FOR MANUFACTURE OF OXYGEN SENSOR

(75) Inventors: James P. Vargo, Swartz Creek; Robert Gregory Kechner, Davison; Raymond Leo Bloink, Swartz Creek, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/520,097

(22) Filed: Mar. 7, 2000

(51) Int. Cl.[7] ..... H01L 21/00; B23P 11/00
(52) U.S. Cl. ..... 438/49; 29/432; 29/465
(58) Field of Search ..... 438/48, 49, 54, 438/55; 29/432, 465; 72/272, 337

(56) References Cited

U.S. PATENT DOCUMENTS 4,805,280 * 2/1989 Elander et al. ..... 29/149.5
4,909,922 * 3/1990 Kato et al. ..... 204/406
5,239,744 * 8/1993 Fleming et al. ..... 29/602.1

FOREIGN PATENT DOCUMENTS

402148853-A * 6/1990 (JP) .

* cited by examiner

*Primary Examiner*—John F. Niebling
*Assistant Examiner*—Viktor Simkovic
(74) *Attorney, Agent, or Firm*—Vincent A. Cichosz

(57) ABSTRACT

Disclosed herein is an apparatus and process for punching and placing inserts of electrolyte and other material into a substrate layer for a gas sensor. The insert can be the solid electrolyte, porous electrolyte or protective layer of a gas sensor. The substrate material is typically alumina. The apparatus punches a hole in the alumina substrate, and then, in one step, punches an insert of a second material, such as a solid electrolyte, into the previously formed hole, thereby forming a composite layer/insert.

19 Claims, 3 Drawing Sheets

METHOD AND APPARATUS FOR PUNCH AND PLACE INSERTS FOR MANUFACTURE OF OXYGEN SENSOR

BACKGROUND OF THE INVENTION

This invention relates generally to exhaust gas sensors, and specifically to exhaust oxygen sensors.

Oxygen sensors are used in a variety of applications that require qualitative and quantitative analysis of gases. For example, oxygen sensors have been used for many years in automotive vehicles to sense the presence of oxygen in exhaust gases, for example, to sense when an exhaust gas content switches from rich to lean or lean to rich. In automotive applications, the direct relationship between oxygen concentration in the exhaust gas and the air-to-fuel ratios of the fuel mixture supplied to the engine allows the oxygen sensor to provide oxygen concentration measurements for determination of optimum combustion conditions, maximization of fuel economy, and the management of exhaust emissions.

A conventional stoichiometric oxygen sensor typically consists of an ionically conductive solid electrolyte material, a porous platinum electrode with a porous protective overcoat on the sensor's exterior exposed to the exhaust gases, and a porous electrode on the sensor's interior surface exposed to a known oxygen partial pressure. Sensors typically used in automotive applications use a yttria-stabilized, zirconia-based electrochemical galvanic cell operating in potentiometric mode, to detect the relative amounts of oxygen present in an automobile engine's exhaust. When opposite surfaces of this galvanic cell are exposed to different oxygen partial pressures, an electromotive force is developed between the electrodes on the opposite surfaces of the zirconia electrolyte, according to the Nernst equation:

$$E = \left(\frac{RT}{4F}\right)\ln\left(\frac{P_{O_2}^{ref}}{P_{O_2}}\right)$$

where:

E=electromotive force

R=universal gas constant

F=Faraday constant

T=absolute temperature of the gas $p_{O_2}^{ref}$=oxygen partial pressure of the reference gas $P_{O_2}$=oxygen partial pressure of the exhaust gas Due to the large difference in oxygen partial pressures between fuel rich and fuel lean exhaust conditions, the electromotive force changes sharply at the stoichiometric point, giving rise to the characteristic switching behavior of these sensors. Consequently, these potentiometric oxygen sensors indicate qualitatively whether the engine is operating fuel rich or fuel lean, without quantifying the actual air to fuel ratio of the exhaust mixture.

Prior art exhaust sensors have utilized solid electrolytes that are disposed as layers independent from supporting materials. Such a configuration requires more raw material and fabrication. What is needed in the art is an apparatus and method for incorporating electrolytes directly into substrate layers in a process that is preferably amenable to automation.

BRIEF SUMMARY OF THE INVENTION

Herein is described a method of placing inserts into a substrate for a gas sensor, comprising punching a hole in a first layer, positioning a die over said first layer, positioning a second layer over said die opposite to said first layer, punching an insert out of said second layer, and, moving said insert through said die into said hole.

An apparatus is also described for doing the same. The apparatus comprises: a first support surface having an aperture; a punch, wherein said punch is aligned with said aperture and said aperture has a diameter equal to or greater than a cross-sectional diameter of said punch; a die having a diameter and cross-sectional geometry substantially similar to the cross-sectional geometry and diameter of said punch; and a second support surface disposed at a second end of said die, wherein when said punch is disposed at a first end of said die, said punch can move through said die toward said second support surface.

BRIEF DESCRIPTION OF THE DRAWINGS

The apparatus and method will now be described by way of example, with reference to the accompanying drawings, which are meant to be exemplary, not limiting, and wherein like elements are numbered alike in the several figures.

DETAILED DESCRIPTION OF THE INVENTION

A method and apparatus for forming an exhaust gas sensor are described herein, wherein electrolyte or other components are incorporated into a supporting substrate material in a single punch and place operation. It is hereby understood that although the apparatus and method are described in relation to making an oxygen sensor, it is understood that the sensor could be a nitrous oxide sensor, hydrogen sensor, hydrocarbon sensor, or the like.

Figure 1:
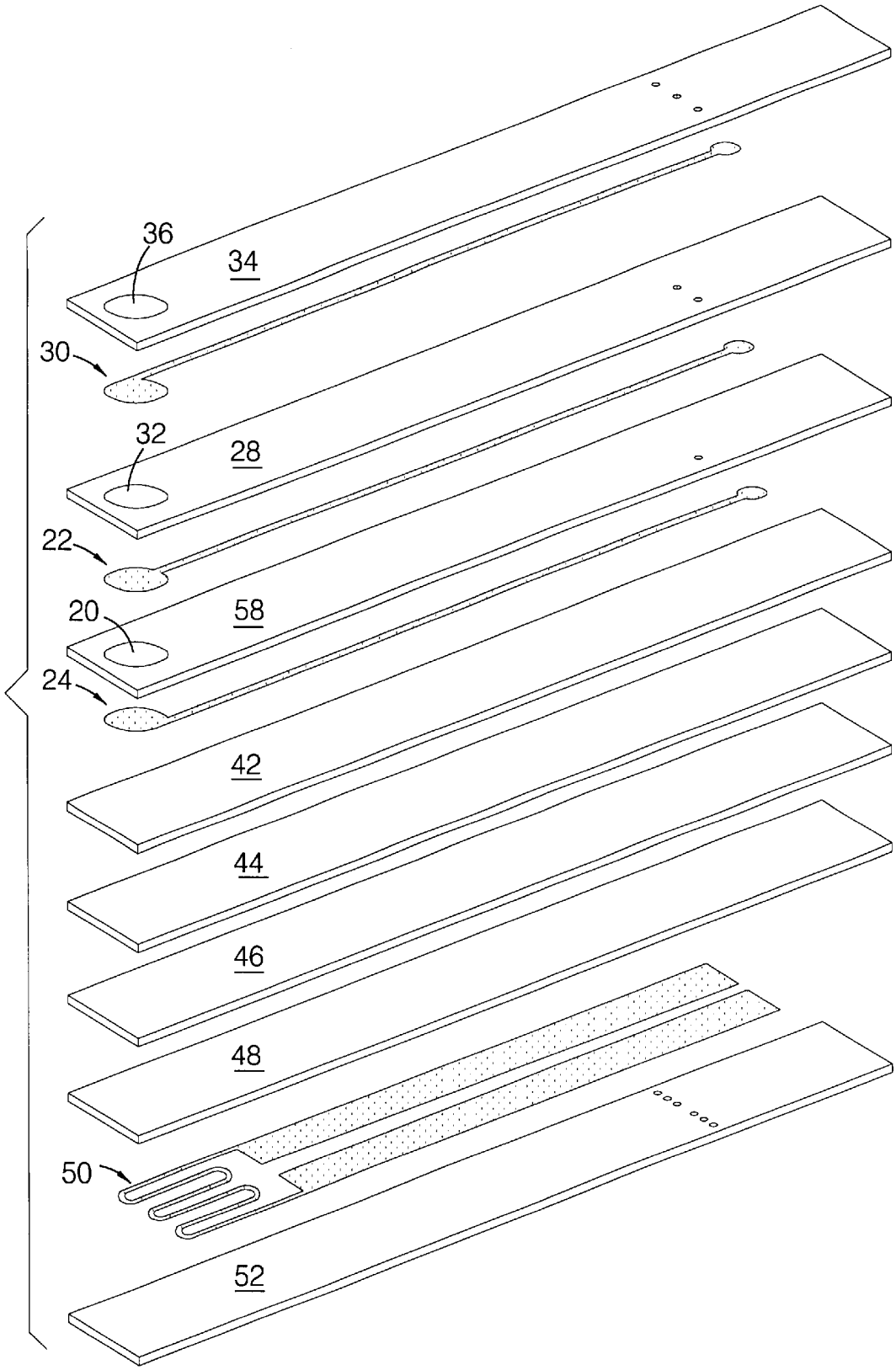
FIG. 1 is an exploded view of an illustrative exhaust gas sensor.

Referring to FIG. 1, which illustrates one of several possible exhaust gas sensor configurations, the sensor comprises a solid electrolyte 20 disposed in a dielectric layer 58, with an inner electrode 22 and a reference electrode 24 disposed on opposite sides thereof; a porous electrolyte 32 disposed in electrical communication with the inner electrode 22 and disposed in a dielectric layer 28; an outer electrode 30 disposed on the side of the porous electrolyte 32 opposite said inner electrode 22; a dielectric layer 34 disposed against said layer 28 opposite said layer 58; several internal support layers 42, 44, 46, 48 disposed against said layer 58; a heater 50 disposed between said layer 48 and a protective outer layer 52; and a protective material 36 disposed in physical contact with said outer electrode 30 and in said layer 34.

The solid electrolyte layer 20 can be any material that is capable of permitting the electrochemical transfer of oxygen ions while inhibiting the physical passage of exhaust gases, preferably has an ionic/total conductivity ratio of approximately unity, and that is compatible with the environment in which the sensor will be utilized. Possible solid electrolyte materials include conventional materials, e.g. metal oxides and the like, such as zirconia, yttria stabilized zirconia, calcia stabilized zirconia, and magnesia stabilized zirconia, among others, and combinations comprising at least one of the foregoing. Typically, the solid electrolyte has a thickness of up to about 500 microns, with a thickness of approximately 25 microns to about 500 microns preferred, and a thickness of about 50 to about 200 microns especially preferred. This electrolyte can be formed via many conventional processes including, but not limited to, die pressing, roll compaction, stenciling and screen printing, and the like. For improved process compatibility, it is preferred to utilize a tape process using known ceramic tape casting methods.

As with the solid electrolyte 20, the porous electrolyte 32 makes use of an applied electrical potential to influence the movement of oxygen. The porous electrolyte 32 should be capable of permitting the physical migration of exhaust gas and the electrochemical movement of oxygen ions, and should be compatible with the environment in which the sensor is utilized. Typically the porous electrolyte 32 has a porosity of up to about 20%, with a median pore size of up to about 0.5 microns, or, alternatively, comprises a solid electrolyte having one or more holes, slits, or apertures therein, so as to enable the physical passage of exhaust gases. Commonly assigned U.S. Pat. No. 5,762,737 to Bloink et al., which is hereby incorporated in its entirety by reference, further describes the porous electrolyte 32. Possible porous electrolytes include those listed above for the solid electrolyte.

The various electrodes 22, 24, 30 disposed in contact with the solid electrolyte 20 and the porous electrolyte 32 can comprise any catalyst capable of ionizing oxygen, including, but not limited to, noble metal catalysts such as platinum, palladium and others, including mixtures and alloys comprising at least one of these materials. The electrodes preferably have a porosity sufficient to permit the diffusion of oxygen molecules without substantially restricting such gas diffusion, said porosity typically being greater than the porosity of the porous electrolyte 32, and a thickness sufficient to attain the desired catalytic activity.

Typically, the size and geometry of the electrodes are adequate to provide current output sufficient to enable reasonable signal resolution over a wide range of air/fuel ratios, while preventing leakage between electrolytes. Generally, a thickness of about 1.0 to about 25 microns can be employed, with a thickness of about 12 to about 18 microns preferred. The geometry of the electrode is preferably substantially similar to the geometry of the electrolyte, with at least a slightly larger diameter than the electrolyte to ensure that the electrode covers the interface, prevent leakage between electrolytes, and allow sufficient print registration tolerance.

The electrodes can be formed using conventional techniques such as sputtering, chemical vapor deposition, screen printing, and stenciling, among others, with screen printing the electrodes onto appropriate tapes preferred due to simplicity, economy, and compatibility with the subsequent co-fired process. For example, reference electrode 24 can be screen printed onto layer 42 or onto the solid electrolyte 20, inner electrode 22 can be screen printed onto solid electrolyte 20 or porous electrolyte 32, and outer electrode 30 can be screen printed onto the porous electrolyte 32 or the protective material 36. Electrode leads and contact holes in the alumina layers are typically formed simultaneously with the electrodes.

Although the porosity of the reference electrode 24 is typically sufficient to hold an adequate quantity of oxygen to act as a reference, a space (not shown) can be provided between the reference electrode 24 and the adjoining layer 42. This space can be formed by depositing a carbon base material, i.e. a fugitive material, between the reference electrode 24 and the layer 42 such that upon processing the carbon burns out, leaving a space.

The electrolytes 20, 32 and the protective material 36 are disposed as inserts in layers 28, 34, 58. These layers 28, 34, 58, as well as the other substrate layers 42, 44, 46, 48, 52, are dielectric materials which effectively protect various portions of the sensor, provide structural integrity, and separate various components. Layers 42, 44, 46, and 48 electrically isolate the heater circuit from the sensor circuits, while layers 34 and 52 physically cover the outer electrode 30 circuit and heater circuit 50, respectively, to provide physical protection, against, for example, abrasion, and to electrically isolate these components from the packaging. Preferably, these layers comprise material having substantially similar coefficients of thermal expansion, shrinkage characteristics, and chemical compatibility, to at least minimize, if not eliminate, delamination and other processing problems. These layers can be up to about 200 microns thick with a thickness of about 50 to about 100 microns preferred. As with the solid and porous electrolytes, these layers can be formed using ceramic tape casting methods or other methods such as plasma spray deposition techniques, screen printing, stenciling and others conventionally used in the art.

Disposed between two of the substrate layers 48, 52 is a heater 50. The heater 50 can be any conventional heater capable of maintaining the oxygen sensor at a sufficient temperature to facilitate the various electrochemical reactions therein. Typically the heater, which is platinum, platinum-alumina, palladium, platinum-palladium, or alloys comprising at least one of the foregoing, is generally screen printed onto a substrate to a thickness of about 5 to about 50 microns.

The electrolytes 32, 20 and protective material 36 are formed as inserts within the substrate material, rather than in separate layers as is conventionally known in the art. The porous electrolyte 32, solid electrolyte 20, and protective material 36 are disposed as inserts in holes through layers 28, 58, and 34, respectively. This arrangement eliminates the use of excess porous electrolyte, solid electrolyte, and protective material, and reduces the size of the sensor by eliminating layers. Any shape can be used for the porous electrolyte 32, solid electrolyte 20, and protective material 36, since the size and geometry of the various inserts, and therefore the corresponding openings, are dependent upon the desired size and geometry of the adjacent electrodes. It is preferred that the openings, inserts, and electrodes have a substantially similar geometry, however, and a substantially circular geometry is preferred in order to reduce stresses within the sensor.

The solid electrolyte 20, porous electrolyte 32, and protective material 36 all can be placed into their respective dielectric layers through a punch and place method. FIGS. 2–5 show cross-sectional views of the apparatus at various stages of punch and place processing. The punch and place processing involves first punching a hole in a substrate material, and then, in a single step (the punch and place step), punching an insert out of a second material and into the previously punched hole. Although FIGS. 2–5 are described as having zirconia as the insert material and alumina as the substrate material, any dielectric material and electrolyte material respectively, can be used with the same result.

Figure 2:
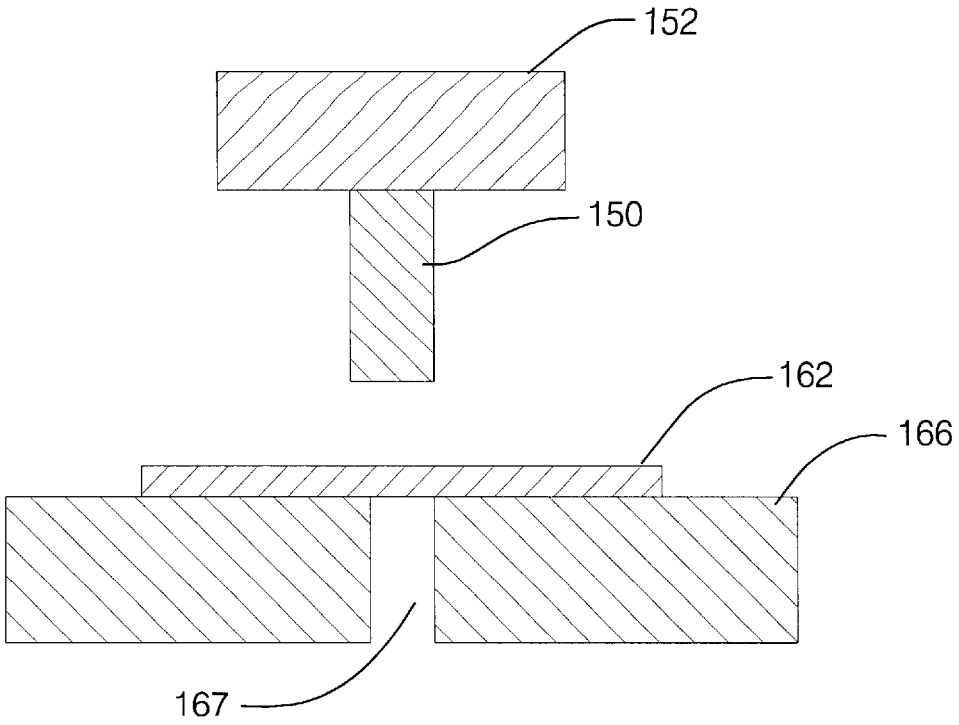
FIG. 2 is a cross-section of a support material layer in position in one embodiment of the apparatus.

Referring now to FIG. 2, punch 150 which has a cross-sectional geometry that matches the desired shape of the insert material to be punched, and is connected to a device 152 for applying a downward force, such as a hydraulic, pneumatic, or hand-operated press. The punch 150 can be moved vertically along its long axis, and must be long enough to properly seat an insert into a substrate (see below). In a preferred embodiment, the punch has a diameter of about 2.0 to about 4.5 millimeters (mm), with a diameter of about 2.0 to about 4.0 mm especially preferred.

A support surface 166 is perpendicularly disposed to the punch 150, and in the initial punching step, a recess 167 is included in the support to allow for passage of the punch 150 and excess substrate material. The recess 167 can preferably be formed so as to substantially match the shape of the punch 150 in order to provide adequate structural integrity to the alumina layer 162 during the punching process. Preferably, recess 167 is a die that matches the punch 150. The support surface 166 supports an alumina layer 162, or tile, which will serve as the support material for the insert. The alumina layer 162 can be initially produced in any desired geometry, with a square tile shape preferred to facilitate punching and placing.

The alumina layer 162 can be maintained in position on the support surface 166 by any conventional technique or device, including magnetic, pneumatic, vacuum, hydraulic, or other technique device, or combination thereof. For example, a control arm (not shown) can be detachably affixed to the alumina layer 162 in a manner that does not interfere with subsequent punching and placing operations. The control arm can be any computer controlled arm known in the art. Preferably, the control arm is held to the alumina layer 162 with a vacuum, or is mechanically attached.

Once the alumina layer 162 is in position on the supporting surface 166, a force of about 10 to about 35 pounds per square inch is applied to the punch 150 by the device 152, and the punch 150 is thereby forced downward into the alumina layer 162. A portion of alumina is thereby punched from the alumina layer 162, and, after the punch 150 is withdrawn to its initial position, the alumina layer 162 defines a hole (not shown), which is approximately the same size and geometry as the cross-sectional size and geometry of the punch 150. After the first hole is punched in the alumina layer 162, the control arm can move the alumina layer 162, and more holes can be punched therein. Coordinates of all holes punched in the alumna layer are preferably controlled by a computer so as to enhance reproducibility.

Figure 3:
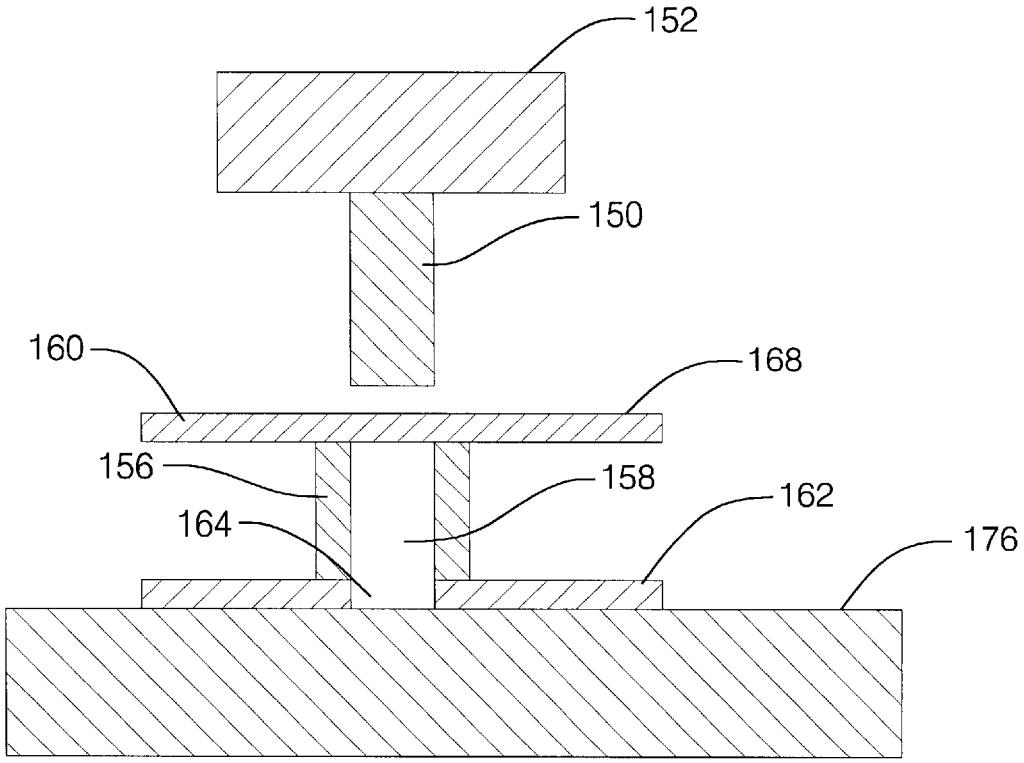
FIG. 3 is a cross-section of the insert material layer in position in one embodiment of the apparatus.

After all initial alumina layer 162 punching is completed, the alumina layer 162 is moved by the control arm (which preferably has remained attached to the layer) onto a solid backing surface 176 (see FIG. 3). Alternatively, supporting surface 166 can be replaced with solid backing surface 176 or recess 167 can be filled with a solid material which will provide adequate support to the inert as it is inserted into the punched hole. The backing surface 176 can be steel, mylar, titanium, aluminum, a hardened, ground tool steel, or any other material that will suffice to prevent the insert from seating incorrectly in the layer of alumina 162 and from protruding through the alumina layer 162.

FIG. 3 shows the apparatus after the hole 164 has been punched in the alumina layer 162, and the apparatus has been prepared for the next step. A die 156 is now fixed in position and the alumina layer 162 is repositioned by the control arm, which has not been removed from the alumina layer 162, so as to align one of the previously punched holes with the die 156. The die 156 defines an aperture 158 that has a geometry that is substantially the same as the cross-sectional geometry of the punch 150. Meanwhile, an insert layer, for example, a zirconia layer 160, is positioned above the die 156. The zirconia layer 160 is preferably in the form of a continuous tape that can be moved with each punch and place operation. The zirconia layer 160 will have the desired characteristics for the component of the sensor it is intended to form.

With the alumina layer 162 and the zirconia layer 160 in place, the one step punch and place operation can be performed by applying force to the punch 150 with the device 152 so as to cause the punch 150 to be moved toward the die 156. Punch 150 is thereby forced into contact with an upper surface 168 of the zirconia layer 160.

Figure 4:
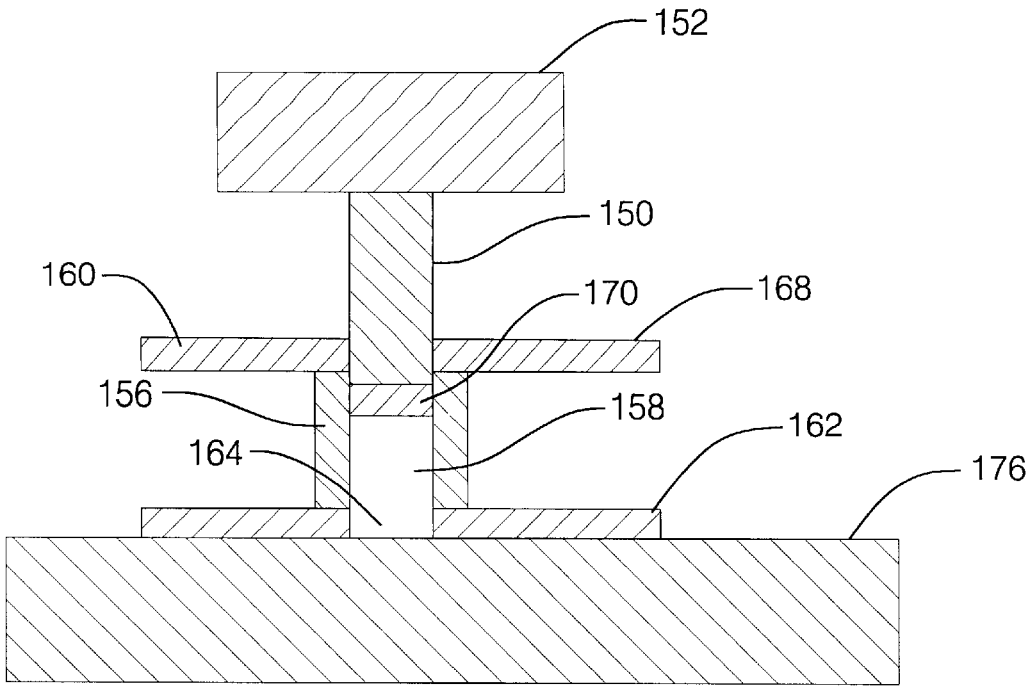
FIG. 4 is a cross-section of the punch and place operation.

Referring now to FIG. 4, as continued force is applied to punch 150, an insert 170 of zirconia is punched out of the zirconia layer 160 and into the aperture 158. Since the aperture 158 has approximately the same cross-sectional geometry and size as the insert 170, the insert 170 is maintained in its position on the end of the punch 150 while the punch 150 is forced downward through the die 156.

Figure 5:
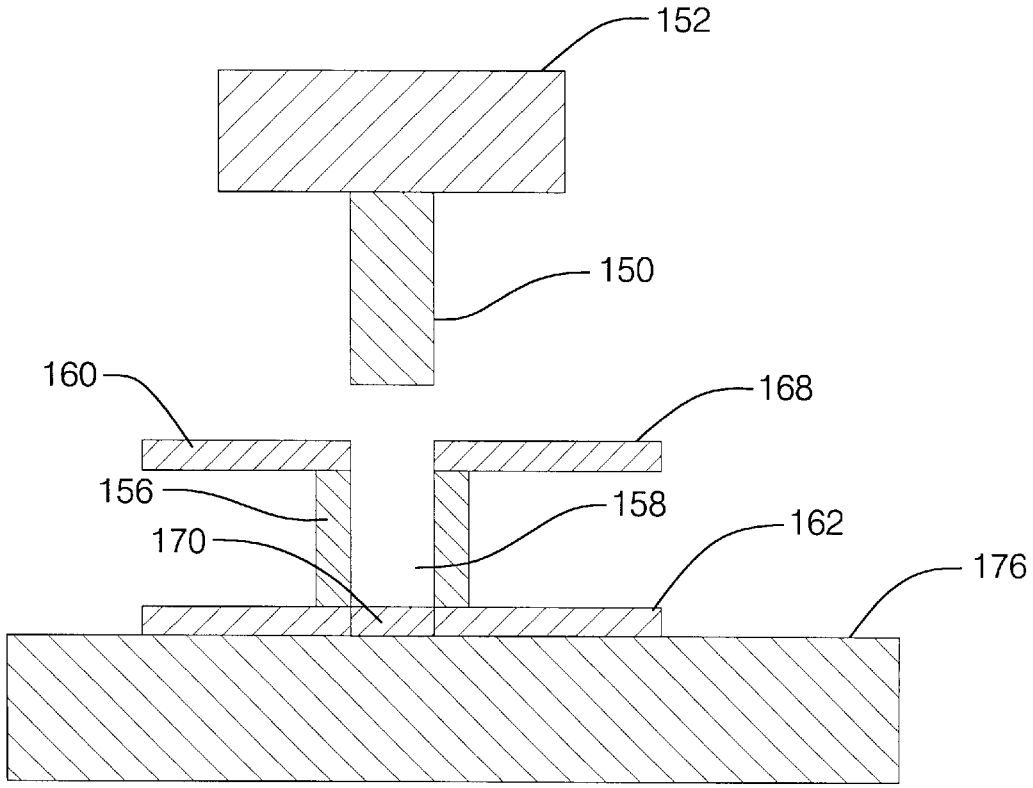
FIG. 5 is a cross-section of the final position of the insert in the support material hole.

Force is applied to punch 150 until the insert 170 is positioned in the alumina hole 164, as shown in FIG. 5. The applied force is sufficient to cause a slight radial deformation in the insert 170, which will cause the insert 170 to be held in position more firmly with compression and frictional forces. Punch 150 is then withdrawn to its original position, leaving a composite layer comprising the zirconia insert 170 placed within the hole 164 in the alumina layer 162.

Once the punch 150 is removed as is shown in FIG. 5, the zirconia layer 160 can be moved so as to position an unpunched area of the zirconia layer 160 under the punch 150. Meanwhile, the control arm moves the alumina layer 162 so that an unfilled hole is positioned under the punch 150 and die 156, and the punch and place process is repeated. The procedure can be repeated as many times as desired on the same tape layers in order to fill all of the original holes punched into the alumina layer 162. New alumina and zirconia layers can then be processed in a similar manner to make the other composite layers of the sensor.

Formation of the sensor is then completed by conventional techniques such as screen printing or otherwise depositing the electrodes, heater, and other components such as leads, contacts, and ground plane onto the layers, stacking the layers appropriately, and laminating the stack. Lamination can occur at a pressure of up to about 4,500 pounds per square inch ("psi") and a temperature up to about 100° C. for a period of up to about 30 minutes, with a pressure of about 3,500 psi to about 4,000 psi, a temperature of about 80° C. to about 90° C. and a period of up to about 20 minutes preferred. The layers can be vacuum sealed in a mylar bag prior to laminating at the above temperatures and pressures in order to limit lamination problems and equalize the pressure. The individual composite electrolyte layers can be sealed in a prelamination step, whereby individual electrolyte composite layers are disposed between layers of mylar or other material, and subjected to high pressure and temperature as above in order to seal the electrolyte and prevent formation of trans-electrolyte shorts during electrolyte deposition.

The apparatus and process allow for rapid fabrication and placement of inserts into their supporting material. Since punching machinery and X-Y type positioning tables are readily automated, the apparatus and method allow for automated processing of zirconia and alumina tapes into finished product, which reduces the time and expense that is conventionally required to make inserts and then manually place the inserts into the substrate, and is more accurate than conventional techniques that use vision system alignment. Additionally, the punch and place method improves sensor uniformity, since all inserts are similarly oriented in the substrate. Finally, the punch and place method can facilitate the insertion of more than one type of insert layer in the same substrate hole.

While preferred embodiments have been shown and described, various modifications and substitutions may be made thereto without departing from the spirit and scope of the invention. Accordingly, it is to be understood that the apparatus and method have been described by way of illustration only, and such illustrations and embodiments as have been disclosed herein are not to be construed as limiting to the claims.

We claim:

1. A method of placing inserts into a substrate for a gas sensor, comprising:

punching a hole in a first layer;

positioning a die over said first layer;

positioning a second layer over said die opposite to said first layer;

punching an insert out of said second layer; and, moving said insert through said die into said hole.

2. The method of claim 1, wherein said hole is punched with a punch having a diameter of about 2.0 to about 4.5 millimeters.

3. The method of claim 1, wherein said first layer comprises alumina.

4. The method of claim 1, wherein said second layer comprises zirconia.

5. The method of claim 1, wherein said first layer and said second layer have a thickness of about 25 to about 500 microns.

6. The method of claim 5, wherein said first layer and said second layer have a thickness of from about 50 to about 200 microns.

7. A method of making a gas sensor, comprising:

a) punching a hole in a substrate layer;

b) positioning a die over said substrate layer;

c) positioning a first insert layer over said die opposite to said substrate layer, wherein said first insert layer comprises an electrolyte;

d) punching a first insert out of said first insert layer;

e) moving said first insert through said die and into said hole to form a first composite layer;

f) disposing a first electrode in physical contact with a first side of said first insert and disposing a first electrical lead in electrical communication with said first electrode;

g) disposing a second electrode in physical contact with a second side of said first insert and disposing a second electrical lead in electrical communication with said second electrode to form an assembly; and h) laminating said first composite layer and said support layers to form the sensor.

8. A method of making a gas sensor as in claim 7, further comprising:

repeating steps (a) through (e) with a second insert layer to form a second composite layer having a second insert, wherein said second insert is a porous material; and disposing said second insert in physical contact with said first electrode.

9. The method of claim 8, further comprising using one or more support layers in physical contact with said second electrode, and disposing a heater in thermal communication with said support layer prior to said laminating.

10. The method of claim 9, further comprising disposing a ground plane in physical contact with at least one of said support layers prior to said laminating.

11. The method of claim 9, wherein said first insert layer comprises zirconia, and said support layers and said first composite layer and said second composite layer comprise alumina.

12. The method of claim 8, wherein said first composite layer and said second composite layer have a thickness of about 25 to about 500 microns.

13. The method of claim 12, wherein said first composite layer and said second composite layer have a thickness of about 50 to about 200 microns.

14. A method of making a gas sensor as in claim 7, further comprising:

repeating steps (a) through (e) with a second insert layer to form a second composite layer having a second insert, wherein said second insert is a porous electrolyte;

disposing a second side of said second insert in physical contact with a second side of said first electrode prior to said laminating;

disposing a third electrode in physical contact with a first side of said second insert and disposing a third electrical lead in electrical communication with said third electrode prior to said laminating;

repeating steps (a) through (e) with a third insert layer to form a third composite layer having a third insert, wherein said third insert layer comprises a porous material; and disposing said third insert in physical contact with a second side of said third electrode prior to said laminating.

15. The method of claim 14, further comprising using one or more support layers in physical contact with said second electrode, and disposing a heater in thermal communication with said support layer prior to said laminating.

16. The method of claim 13, further comprising disposing a ground plane in physical contact with at least one of said support layers prior to said laminating.

17. The method of claim 14, wherein said first insert layer and said third insert layer comprise zirconia, and said support layers, said first composite layer, said second composite layer, and said third composite layer comprise alumina.

18. The method of claim 14, wherein said first composite layer, said second composite layer, and said third composite layer have a thickness of about 25 to about 500 microns.

19. The method of claim 18, wherein said first composite layer, said second composite layer, and said third composite layer have a thickness of about 50 to about 200 microns.

* * * * *